US010221824B2

(12) United States Patent
Tanaya

(10) Patent No.: US 10,221,824 B2
(45) Date of Patent: Mar. 5, 2019

(54) IGNITION DEVICE

(71) Applicant: Mitsubishi Electric Corporation, Tokyo (JP)

(72) Inventor: Kimihiko Tanaya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/486,792

(22) Filed: Apr. 13, 2017

(65) Prior Publication Data

US 2018/0135589 A1 May 17, 2018

(30) Foreign Application Priority Data

Nov. 14, 2016 (JP) ..... 2016-221137

(51) Int. Cl.
*F02F 1/08* (2006.01)
*F02P 7/06* (2006.01)
*F02P 1/08* (2006.01)

(52) U.S. Cl.
CPC .. *F02P 7/06* (2013.01); *F02P 1/08* (2013.01)

(58) Field of Classification Search
None
See application file for complete search history.

(56) References Cited

U.S. PATENT DOCUMENTS 7,895,994 B2 * 3/2011 Yamada ..... H01T 13/50 123/143 B
8,760,067 B2 * 6/2014 Burrows ..... F02P 23/04 315/209 T
9,035,564 B1 * 5/2015 Itoi ..... H01T 15/00 315/224
9,181,920 B2 * 11/2015 Burrows ..... F02P 23/04
9,382,894 B2 * 7/2016 Muramoto ..... F02P 3/01
9,397,483 B2 * 7/2016 Muramoto ..... H01T 15/00
9,458,816 B2 * 10/2016 Aida ..... F02P 15/00
9,646,795 B2 * 5/2017 Komatsu ..... H02H 7/1216
9,777,695 B2 * 10/2017 Itoi ..... F02P 9/002
9,806,504 B2 * 10/2017 Yoshitomo ..... H01H 69/00
9,848,484 B2 * 12/2017 Tabata ..... C01B 13/11
2012/0249006 A1 10/2012 Burrows
2012/0249163 A1 10/2012 Burrows
(Continued)

FOREIGN PATENT DOCUMENTS

GB 2063996 A * 6/1981 ..... F02P 1/086
JP 2014-513760 A 6/2014

*Primary Examiner* — Douglas W Owens
*Assistant Examiner* — Srinivas Sathiraju
(74) *Attorney, Agent, or Firm* — Sughrue Mion, PLLC; Richard C. Turner

(57) ABSTRACT

In an ignition device having high voltage wiring, the ignition device which prevents and/or suppresses the occurrence of serious damage due to an electric shock is provided. In the ignition device which includes: an ignition plug that generates a plasma discharge; a DC/AC conversion device that outputs AC power toward the ignition plug; a DC power supply device which is arranged in a different package from that of the DC/AC conversion device and outputs DC power to the DC/AC conversion device via wiring; and a power circuit breaker that conducts and/or interrupts the output of said DC power supply device, the power circuit breaker interrupts the output of the DC power supply device at least once between ignition operation and ignition operation.

12 Claims, 6 Drawing Sheets

(56) References Cited

U.S. PATENT DOCUMENTS

| | | | | |
|---|---|---|---|---|
| 2015/0115827 | A1* | 4/2015 | Itoi | H01T 15/00<br>315/224 |
| 2015/0322900 | A1* | 11/2015 | Tanaya | F02M 26/49<br>123/568.21 |
| 2016/0138552 | A1* | 5/2016 | Itoi | F02P 9/002<br>315/127 |
| 2016/0164263 | A1* | 6/2016 | Muramoto | F02P 9/007<br>315/279 |

* cited by examiner

IGNITION DEVICE

BACKGROUND OF THE INVENTION

1. Field of the Invention

The present invention relates to an ignition device that mainly uses a plasma discharge by alternative current (AC) power.

2. Description of the Related Art

In recent years, the problem of environmental conservation and fossil fuel depletion has been raised and it becomes an urgent need to deal with these also in the automotive industry. As an example dealing with this, there is a method of dramatically improving the amount of fuel consumption by reducing a pumping loss by the use of exhaust gas recirculation (EGR).

However, combusted gas, which is exhaust air, is incombustible and has a larger thermal capacity than that of air; and accordingly, if a large amount of combusted gas is sucked again by the EGR, a problem exists in that ignition quality and combustion quality deteriorate.

As one of solutions of this problem, there has been proposed an ignition device shown in, for example, Patent Document 1, in which a corona discharge is used to ignite at many points and in a wide range, whereby a more stable flame kernel can be formed and combustion quality can be stabilized.

The ignition device disclosed in Patent Document 1 is used, whereby the more stable flame kernel can be formed as compared to a conventional ignition coil and stable combustion can be obtained even when, for example, the aforementioned amount of EGR gas is supplied. Therefore, since larger EGR can be supplied and a pumping loss can be reduced as compared to the conventional ignition device by using, for example, the ignition device disclosed in Patent Document 1, there can be obtained an internal combustion engine that can dramatically improve the amount of fuel consumption.

Patent Document 1: Japanese Translation of PCT International Application No. 2014-513760

In the ignition device disclosed in Patent Document 1, an energy supply section (high voltage supply device) and a driving circuit are arranged as different packages and these can be connected by wiring.

In the ignition device disclosed in Patent Document 1, as a voltage supplied from the energy supply section becomes higher, a step-up rate from the driving circuit to the ignition coil can be suppressed lower and a current to be supplied to the ignition coil can be suppressed smaller; and therefore, operation can be efficiently performed.

However, when the voltage of the energy supply section connected to the driving circuit by wiring is raised, an electric shock and/or a leak may be caused by coating deterioration of the wiring, a fitting defect of a connector, a disconnection, and the like.

SUMMARY OF THE INVENTION

The present invention has been made to solve the aforementioned problem, and an object of the present invention is to prevent and/or suppress the occurrence of serious damage due to an electric shock in an ignition device having high voltage wiring which may cause an electric shock.

According to the present invention, there is provided an ignition device including: an ignition plug which generates a plasma discharge as ignition operation that is for generating combustion; a DC/AC conversion device which converts direct current (DC) power into AC power and outputs the converted AC power toward the ignition plug; a DC power supply device which is arranged in a different package from that of the DC/AC conversion device, generates the DC power that is for being converted into the AC power by the DC/AC conversion device, and outputs the DC power to be supplied to the DC/AC conversion device via wiring; and a power circuit breaker that conducts and/or interrupts the output of the DC power supply device. The power circuit breaker interrupts the output of the DC power supply device at least once between the ignition operation and the ignition operation.

According to the ignition device according to the present invention, the ignition device includes: the ignition plug that generates the plasma discharge; the DC/AC conversion device that outputs the AC power in which the DC power is converted into the AC power toward the ignition plug; the DC power supply device which is arranged in the different package from that of the DC/AC conversion device, generates the DC power that is for being converted into the AC power by the DC/AC conversion device, and outputs the DC power to be supplied to the DC/AC conversion device via the wiring; and the power circuit breaker that conducts and/or interrupts the output of the DC power supply device. The power circuit breaker interrupts the output of the DC power supply device at least once between the ignition operation and the ignition operation, whereby a continuous electric shock can be prevented and the occurrence of serious damage can be prevented and/or suppressed.

The foregoing and other object, features, aspects, and advantages of the present invention will become more apparent from the following detailed description of the present invention when taken in conjunction with the accompanying drawings.

DETAILED DESCRIPTION OF THE INVENTION

Embodiment 1

Figure 1:
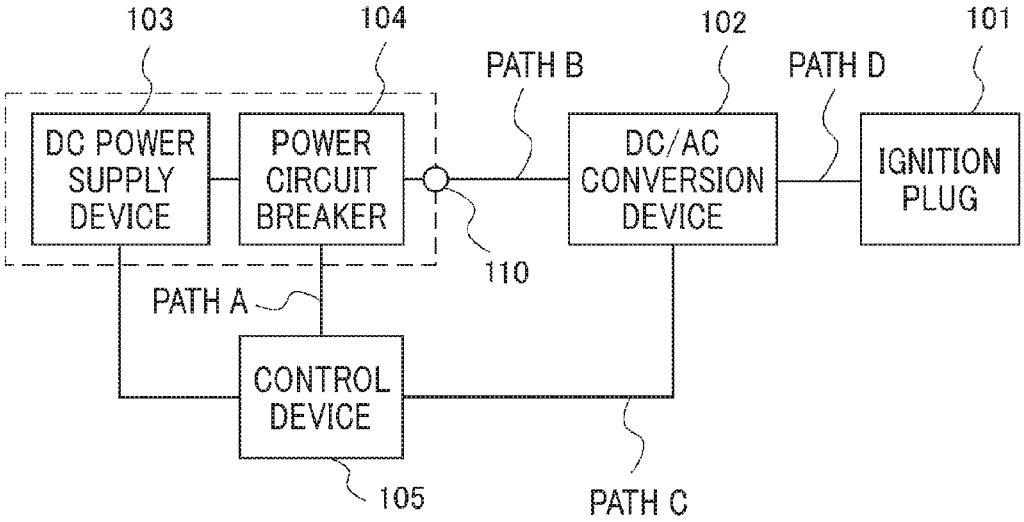
FIG. 1 is a block diagram showing a configuration example of an ignition device according to Embodiment 1 of the present invention.

FIG. 1 is a configuration diagram of an ignition device in an internal combustion engine that performs intermittent combustion according to Embodiment 1 of the present invention.

In FIG. 1, the ignition device according to Embodiment 1 of the present invention includes: an ignition plug 101; a DC/AC conversion device 102 which supplies AC power that is for generating a plasma discharge by the ignition plug 101; a DC power supply device 103 that supplies DC power to the DC/AC conversion device 102; a power circuit breaker 104 that performs switching between interruption and conduction of output power (DC power) of the DC power supply device 103; and a control device 105 that controls the operation of the power circuit breaker 104.

A high frequency AC and high voltage power come and go between the DC/AC conversion device 102 and the ignition plug 101.

Accordingly, in order to suppress radiation noise and/or in order to improve the transmission efficiency of the power, the DC/AC conversion device 102 and the ignition plug 101 need to be arranged as near as possible by keeping wiring as short as possible.

However, in the internal combustion engine having the ignition device, such as a vehicular engine, a space near the ignition plug is small; and accordingly, the configuration of this device needs to be minimized in order to arrange the device, which outputs the high frequency AC and high voltage power, near the ignition plug.

Since only DC power comes and goes between the DC power supply device 103 and the DC/AC conversion device 102 and there is little possibility of radiation noise, power transmission loss, and the like, the DC power supply device 103 does not need to be arranged near the ignition plug 101.

Therefore, the DC power supply device 103 and the DC/AC conversion device 102 are arranged in different packages, the DC/AC conversion device 102 is arranged near the ignition plug 101, the DC power supply device 103 is arranged at a little distant place that permits a space, and these are connected by wiring.

The power circuit breaker 104 is arranged in the same package together with the DC power supply device 103. Such a shared package portion is shown by a dashed line block in FIG. 1. The same can be said about FIG. 4 and FIG. 5 to be described later.

As described above, the DC power supply device 103 and the DC/AC conversion device 102 are arranged in the different packages and are connected by the wiring; however, in the case where an output voltage of the DC power supply device 103 is high, for example, in the case where the output voltage is higher than 60 v, an electric shock may be caused.

If, in a state where coating of the wiring is damaged and/or a connection connector of the wiring is not properly fitted, there may directly come in contact with an electrical path. If coming in contact with the electrical path, an electric shock is received; and if an electric shock state continues for a long time, serious damage may occur.

In order to avoid the serious damage, the power circuit breaker 104 is arranged before an output terminal 110 through which the DC power generated by the DC power supply device 103 is outputted to the DC/AC conversion device 102, that is, between the DC power supply device 103 and the output terminal 110.

The damage due to the electric shock is mainly a burn injury due to a long-time electric shock. If receiving an electric shock by DC continuous power, a body cannot be moved by muscle spasms and the like and an escape from the electric shock state cannot be made, and this results in the long-time electric shock and thus the damage becomes severe. Therefore, the power is not continuously supplied for a long time, the time to be supplied at one time is shortened as much as possible, and the time in which the power is not supplied is surely provided, whereby the long-time electric shock is prevented and a chance to escape from the electric shock state can be created even if the electric shock is received.

The operation of the power circuit breaker 104 will be described by using the configuration block diagram of FIG. 1 and a timing chart of FIG. 2.

In FIG. 1, a path, through which the control device 5 sends a signal that controls the power circuit breaker 104, is regarded as a path A; a path, through which the output terminal 110 to which the DC power is outputted is connected to the DC/AC conversion device 102, is regarded as a path B; a path, through which the control device 5 sends a signal that designates the operation of t DC/AC conversion device 102, is regarded as a path C; and a path, through which the output side of the DC/AC conversion device 102 is connected to the ignition plug 101 and an AC current comes and goes, is regarded as a path D.

Figure 2:
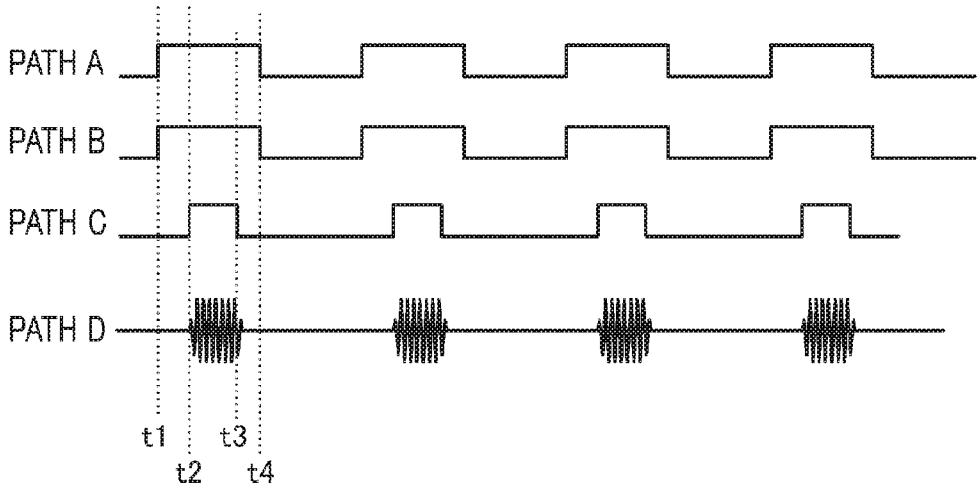
FIG. 2 is a view showing an example of an operation timing chart of the ignition device according to Embodiment 1 of the present invention.

In FIG. 2, each state of a voltage signal of the path A, a voltage state of the path B, a voltage signal of the path C, and current output of the path D is shown in temporal sequence.

The control device 105 sets a signal state of the path A to a state of high(H) so that the power circuit breaker 104 becomes a conduction state at a timing t1. In response to this, the power circuit breaker 104 is conducted and a voltage is generated in the path B.

The control device 105 switches a signal state of the path C to a state of high(H) at a timing t2 at which the voltage is generated in the path B and starts the operation of the DC/AC conversion device 102. In response to this, an AC current flows in the path D and a plasma discharge is generated between electrodes of the ignition plug 101 to combust fuel in the engine.

The control device 105 sets the signal state of the path C to a state of low(L) at a timing t3, stops the operation of the DC/AC conversion device 102, and also stops the AC current that flows in the path D.

After a while, if the control device 105 sets the signal state of the path A to a state of low(L) at a timing t4, the power circuit breaker 104 becomes an interruption state and the voltage of the path B also decreases. Such an ignition operation is repeated with a predetermined time interval as shown in, for example, FIG. 2.

As described above, the power circuit breaker 104 interrupts the output of the DC power supply device 103 at least once between the ignition operation and the ignition operation.

Figure 3:
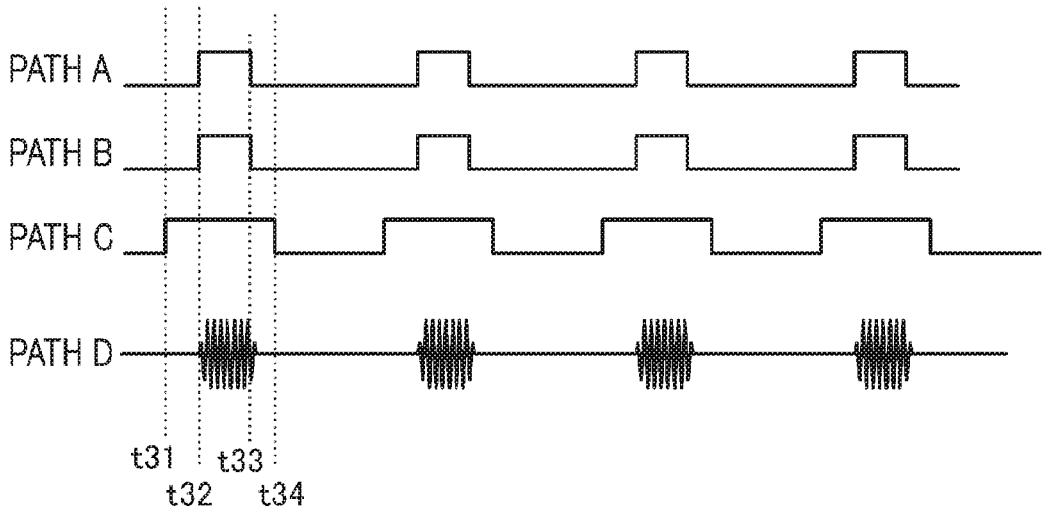
FIG. 3 is a view showing another example of the operation timing chart of the ignition device according to Embodiment 1 of the present invention.

In the above mention, the signal of the path C functions as a period in which the AC current flows in the path D, that is, a period in which the plasma discharge is generated between the electrodes of the ignition plug; however, as shown in FIG. 3, a signal of a path A may function as a plasma discharge period. In this case, first, the DC/AC conversion device 102 starts operation from a point of time of a timing t31; however, since the DC power is not supplied to the DC/AC conversion device 102, an AC current does not flow in a path D.

The power circuit breaker 104 is conducted at a timing t32, the AC current starts to flow in the path D at the same time as a voltage is generated in a path B. If the power circuit breaker 104 becomes an interruption state at a timing t33, the voltage of the path B also decreases and the AC current of the path D is also stopped. Therefore, it can be said that the signal of the path A functions as the plasma discharge period. The control device 105 sets a signal state of a path C to a state of low(L) at a timing t34 and stops the operation of the DC/AC conversion device 102.

In the actual device, the wiring, the circuit, the element, and the like have stray capacitance components; and accordingly, the voltage remains in the path B for a while even after the power circuit breaker 104 is interrupted. Consequently, this method according to FIG. 3 is in a direction in which control accuracy as a plasma discharge supply period is reduced as compared to that of FIG. 2; however, this method is in a direction which is to be shortened as a period in which the voltage is generated in the path B and it can be said that this method is safer.

Description will be made by using a specific example. A device shown in FIG. 4 is used for use in motor vehicles and is referred to as a corona ignition device which is developed as a device that is for stably igniting air-gasoline mixture in the engine.

Figure 4:
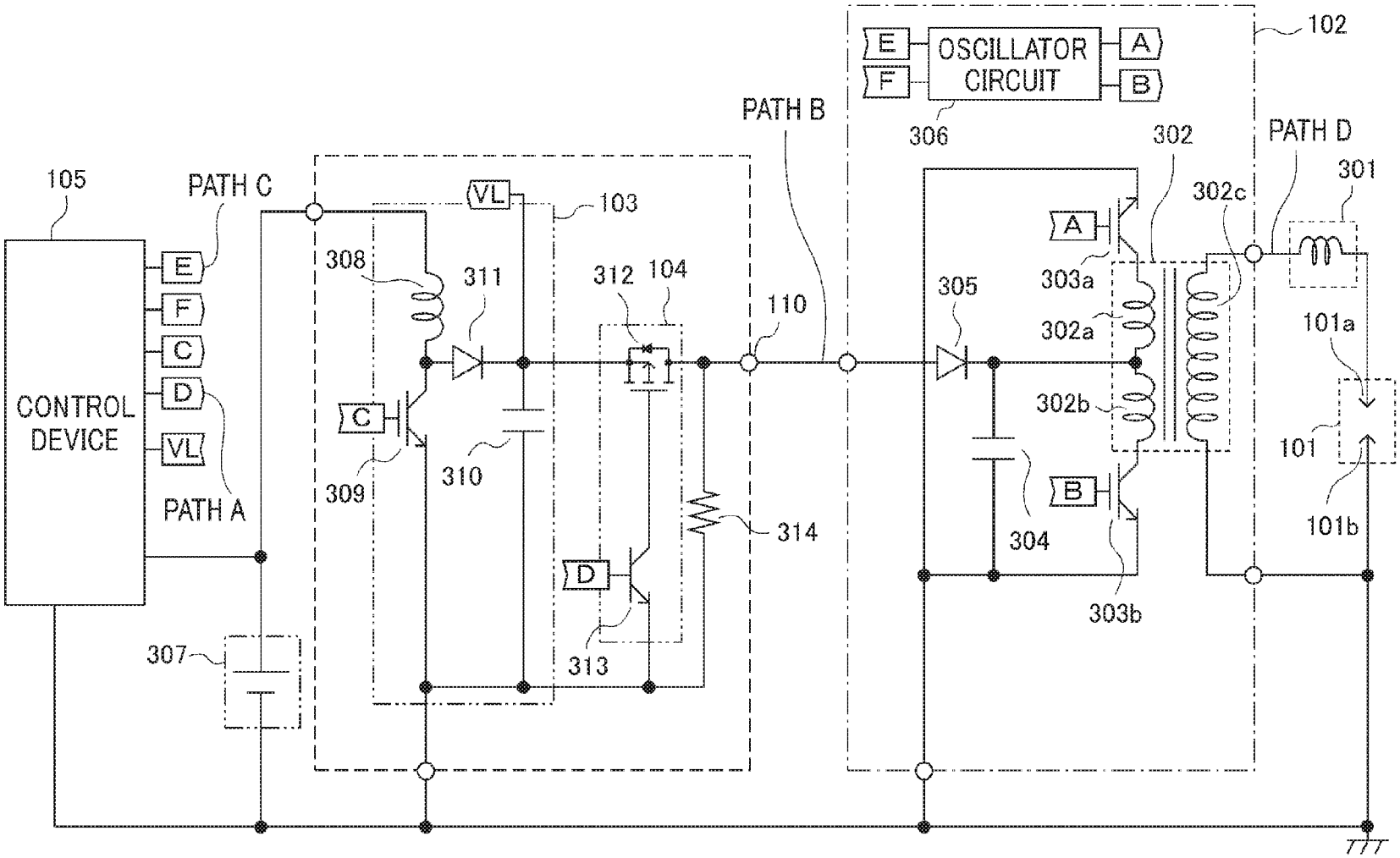
FIG. 4 is a view showing a specific configuration example of the ignition device according to Embodiment 1 of the present invention.

Similar to FIG. 1, the ignition device shown in FIG. 4 includes: an ignition plug 101; an inverter that is a DC/AC conversion device 102; a DC power supply device 103; a power circuit breaker 104; and a control device 105. Additionally, the ignition device includes a step-up reactor 301 which generates a high voltage that is for generating a corona discharge by using an output current of the DC/AC conversion device 102.

The DC/AC conversion device 102 includes: a transformer 302 composed of a first primary winding 302*a*, a second primary winding 302*b*, and a second secondary winding 302*c*; a first insulated gate bipolar transistor (IGBT)_A 303*a* connected to the ground (GND) side of the first primary winding 302*a*; a second IGBT_B 303*b* connected to the ground (GND) side of the second primary winding 302*b*; a stabilization capacitor 304 that is for stabilizing DC power supplied from the DC power supply device 103; a diode 305 that prevents backward flow of an electric charge stored in the stabilization capacitor 304; and an oscillator circuit 306 which generates a signal A that drives a gate of the first IGBT_A 303*a* and a signal B that drives a gate of the second IGBT_B 303*b* on the basis of designations of the control device 105.

The DC power supply device 103 includes: a reactor 308 connected to a battery 307, a third IGBT_C 309 that controls energization to the reactor 308, a capacitor 310 that stores a boosted electric charge, and a diode 311 that prevents the electric charge stored in the capacitor 310 from flowing back to the battery 307; and this constitutes a step-up device referred to as a "chopper."

The power circuit breaker 104 includes: a p-field effect transistor (FET) 312 arranged between the high voltage side of the capacitor 310 and an output terminal 110; and a transistor 313 that controls a gate of the p-FET 312. A resistor 314 is connected to the output terminal 110 so that a potential is not undefined when the output terminal 110 is in a state of non-connection and floating.

Description will be started from a state where a voltage of the battery 307 is boosted by the chopper in the DC power supply device 103 and the boosted electric charge is stored in the capacitor 310. Furthermore, in order to make more specific, the description will be made by using numerical values; however, the present invention is not limited to the numerical values used in the embodiment.

The battery voltage is boosted to 100 v by the chopper in the DC power supply device 103. Therefore, the capacitor 310 is charged to about 100 v. The control device 105 monitors this voltage as VL; and if the voltage falls below a predetermined value, for example, 80 v, the chopper is made to operate so that the capacitor 310 is constantly charged to about 100 v.

The operation will be described by using the configuration diagram of FIG. 4 and the timing chart of FIG. 2. Incidentally, signals A to F represent signals which are outputted from each constituent element and/or inputted to each constituent element. The control device 105 sets a state of a signal D to high(H) at a timing t1. The signal D is a signal that controls a base of the transistor 313. Since the gate of the p-FET 312 becomes a state of low(L), the p-FET 312 is turned ON and becomes a conduction state and the path B becomes about 100 v that is the same potential as the charging voltage of the capacitor 310.

The control device 105 sets a state of the signal E to high(H) so that the oscillator circuit 306 operates at a timing t2 in a state in which the path B becomes about 100 v. The oscillator circuit 306 starts operation and starts the output of the signal A and the signal B which are in inverse relation to each other. Furthermore, the control device 105 controls the oscillator circuit 30 via 6 the signal F so that an oscillation cycle becomes a resonance frequency between the step-up reactor 301 and a stray capacity of the ignition plug 101, for example, 100 kHz.

If the signals A and B alternately repeat high(H) and low(L), a primary current alternately flows in the first primary winding 302*a* and the second primary winding 302*b* and, in response to this, an AC current is induced in the secondary winding 302*c*, the three windings constituting the transformer 302.

If the AC current is supplied at the above-mentioned resonance frequency, an AC high voltage is generated at a high voltage electrode 101*a* of the ignition plug 101 and a discharge plasma is generated between the high voltage electrode 101*a* and the ground (GND) electrode 101*b* to ignite the fuel.

If the control device 105 sets the state of the signal E to low(L) at a timing t3 and stops the operation of the oscillator circuit 306, the supply of the signal A and the signal B is also stopped and the AC current that flows in a path D is also stopped. Both of the signal A and the signal B are stopped in the state of low(L).

After a while, if the control device 105 sets the signal D to a state of low(L) at a timing t4 at which, for example, 100 μsec is elapsed after stop designation of the oscillator circuit, the gate of the p-FET 312 becomes a state of high(H), the p-FET 312 is turned off, the path becomes an interruption state, and the supply of 100 v to the path B is stopped.

As described above, according to this Embodiment 1, since the voltage is generated only when necessary in the path B that appears on the surface as the wiring and power is not continuously supplied for a long time, there can be provided a safe ignition device in which even when coming in contact with an electric line, it results in a short-time electric shock and it can smoothly escape from an electric shock state.

Furthermore, the power circuit breaker 104 is arranged in the same package together with the DC power supply device 103, whereby a continuous electric shock can be reliably prevented and the occurrence of serious damage can be prevented and/or suppressed.

Moreover, the power circuit breaker 104 conducts the output of the DC power supply device 103 before the DC/AC conversion device 102 starts operation that is for outputting AC power toward the ignition plug 101, whereby a continuous electric shock can be prevented and the occurrence of serious damage can be prevented and/or suppressed.

Additionally, the power circuit breaker 104 conducts the output of the DC power supply device 103 after the DC/AC conversion device 102 starts operation that is for outputting AC power toward the ignition plug 101, whereby a continuous electric shock can be further prevented and the occurrence of serious damage can be prevented and/or suppressed.

In addition, the power circuit breaker 104 interrupts the output of the DC power supply device 103 before the DC/AC conversion device 102 stops operation that is for outputting AC power toward the ignition plug 101, whereby a continuous electric shock can be further prevented and the occurrence of serious damage can be prevented and/or suppressed.

Besides, the power circuit breaker 104 interrupts the output of the DC power supply device after the DC/AC conversion device 102 stops operation that is for outputting AC power toward the ignition plug 101, whereby a continuous electric shock can be prevented and the occurrence of serious damage can be prevented and/or suppressed.

Embodiment 2

Most parts of Embodiment 2 have the same configuration as that of the ignition device of Embodiment 1; however, in addition to the configuration, Embodiment 2 provides a safer ignition device that can prevent the destruction of the device and/or a leak by configuring so as to determine whether or not a power circuit breaker 104 is set to be a conduction state after confirming a connection state of a path B.

Figure 5:
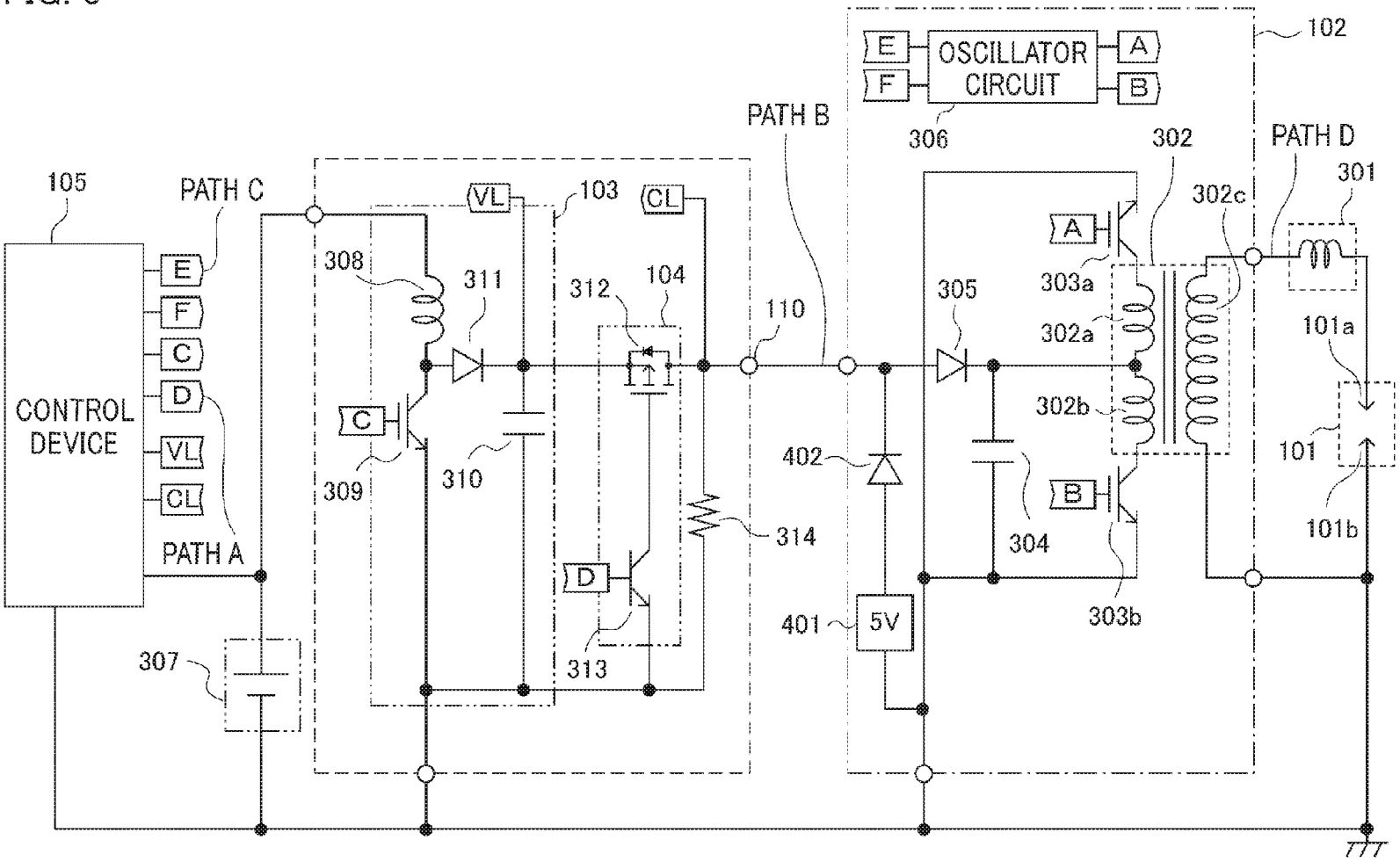
FIG. 5 is a view showing a specific configuration example of an ignition device according to Embodiment 2 of the present invention.
Figure 6:
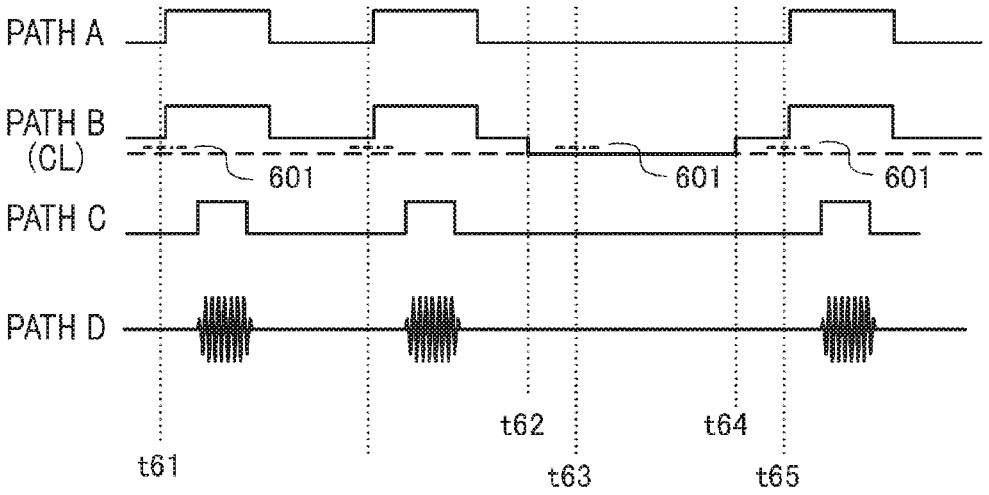
FIG. 6 is a view showing an example of an operation timing chart of the ignition device according to Embodiment 2 of the present invention.

The operation of the power circuit breaker 104 will be described by using a configuration diagram of FIG. 5 and a timing chart of FIG. 6. For example, as shown in FIG. 5, a 5 volt power supply 401 is arranged in a DC/AC conversion device 102. An output of 5 v is connected to the path B via a diode 402. The 5 volt power supply 401 and the diode 402 constitute a conduction confirmation device which confirms that wiring (path) through which the output of a DC power supply device 103 is connected to the DC/AC conversion device 102 is connected, and outputs a result of conduction confirmation. Incidentally, in FIG. 5, the same reference numerals as those shown in FIG. 4 represent identical or corresponding parts.

A control device 105 monitors a voltage state CL of an output terminal 110. As shown in FIG. 6, the voltage state CL becomes about 100 v when the path B is in a connected state and a p-FET 312 is turned ON and is in a conduction state; and the voltage state CL becomes 5 v if the p-FET 312 is turned OFF and is in an interruption state. If the path B is in a disconnection state, the voltage state CL becomes about 100 v when the p-FET 312 is in the conduction state: and the voltage state CL becomes 0 v if the p-FET 312 is in the interruption state.

Figure 7:
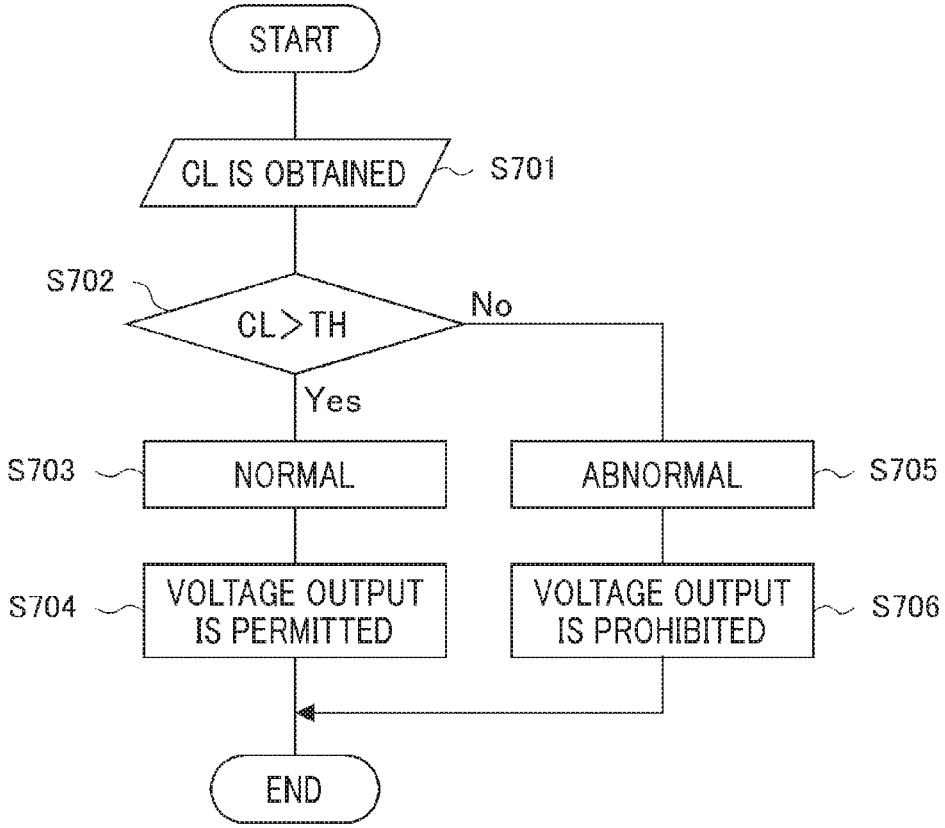
FIG. 7 is a view showing an example of an operation flowchart of the ignition device according to Embodiment 2 of the present invention.

Description will be made along the timing chart of FIG. 6 and a flowchart of FIG. 7. The control device 105 checks the voltage state CL before a signal D is set to be a state of high(H), that is, at a timing t61 at which a p-FET 313 is turned ON (step S701). A threshold value TH 601 is compared to the voltage state CL (step S702); if CL>TH, there is no problem (determined as normal) (step S703); the signal D is set to be the state of high(H); and voltage output is permitted and normal ignition procedure is performed (step S704). For example, the threshold value TH is set to be 2 v; and since CL is 5 v at the timing t61, it becomes a state of CL>TH.

It is assumed that the path B is disconnected at a timing t62. Since 5 v is not supplied to the output terminal 110 at this point, the voltage state CL drops to 0 v. The voltage state CL is compared to the threshold value TH at a timing t63 in the next ignition (step S702). According to FIG. 6, since CL is 0 V and TH is 2 v, it becomes a state of CL TH. Therefore, the control device 105 determines that the path B is disconnected (determined as abnormal) (step S705), voltage output is prohibited, and the p-FET 312 is not turned ON (step S706). At this point, since it is unclear in which state the disconnected wire is, the operation of an inverter that is the DC/AC conversion device 102 is also prohibited.

It is assumed that the path B is connected at a timing t64. The control device 105 compares the voltage state CL with the threshold value TH at a timing t65 in the next ignition (step S702). Since CL is 5 V and TH is 2 v, it becomes the state of CL>TH, the state is determined as normal (step S703), the signal D is switched to the state of high(H), the p-FET 312 is turned ON (step S704), and normal ignition operation is performed.

In the above-mention, the turning ON/OFF of the p-FET 312 is determined by only the comparison result between the voltage state CL and the threshold value TH; however, when the state of CL≤TH (also referred to as "NG") appears a predetermined times or more within a predetermined time, a flag FLG is set to ON to light, for example, a malfunction indicator lamp (MIL) (warning lamp). After that, even when the result of the state of CL>TH (also referred to as "OK") is obtained, the result is checked by service and the like, and it may be set so that the p-FET 312 is not turned on until the flag FLG is manually released.

Figure 8:
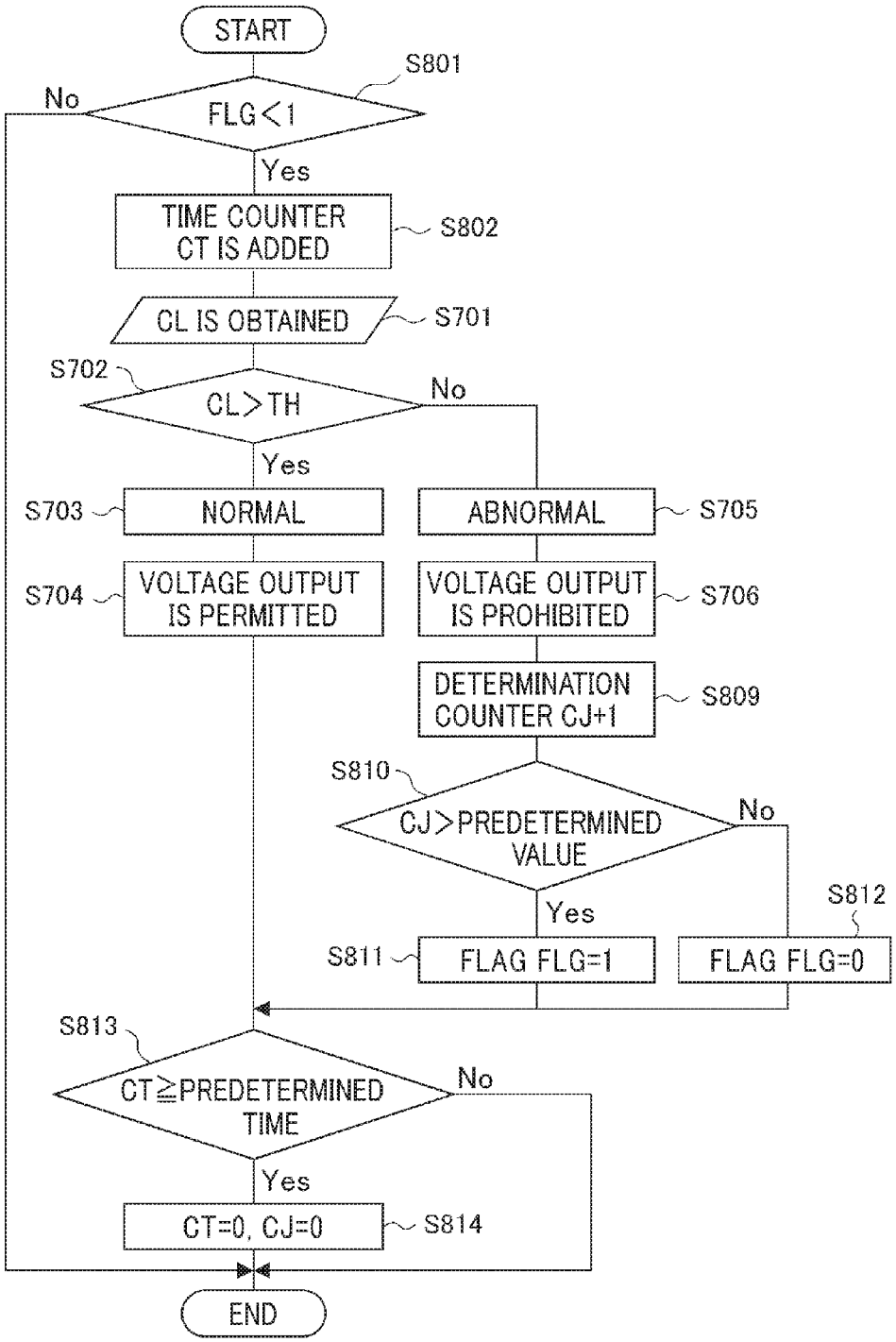
FIG. 8 is a view showing another example of the operation flowchart of the ignition device according to Embodiment 2 of the present invention.

Description will be made by a flowchart of FIG. 8. First, the flag FLG is confirmed (step S801). If the flag FLG is 1, the process is in a state of waiting for check by the service and the process flow is ended without doing anything. If the flag FLG is 0, a time counter CT, which measures a predetermined time, is advanced (step S802). The processes from the check of the voltage state CL (step S701) to step S706 are the same as the flowchart shown in FIG. 7 and therefore the description here will be omitted.

If, in the case where it becomes the state of CL≤TH, a determination is made as abnormal (step S705), and voltage output is prohibited (step S706), an abnormal determination counter CJ is incremented by one (step S809). The abnormal determination counter CJ is compared to a predetermined value (step S810); and if the abnormal determination counter CJ is larger than the predetermined value, the flag FLG is set to be 1 (FLG=1) (step S811). If the abnormal determination counter CJ is equal to or less than the predetermined value, the flag FLG is set to be 0 (FLG=0) (step S812).

Confirmation is made whether the time counter CT elapses the predetermined time (step S813); and if the time counter CT elapses the predetermined time, each counter is reset by setting the time counter CT to 0 (CT=0) and by setting the abnormal determination counter CJ to 0 (CJ=0), and the process flow comes to an end.

For example, the determination is made each time as described above until reaching 10 times per minute for integration, the operation of the p-FET 312 is switched each time; and it is regarded as the abnormal state at a point at which a tenth NG for integration is detected and the flag FLG is rewritten to 1 (0 in the normal state).

As described above, according to this Embodiment 2, since the voltage is generated only when necessary in the path B that appears on the surface as the wiring and power is not continuously supplied for a long time, there can be provided a safe ignition device in which even when coming in contact with an electric line, it results in a short-time electric shock and it can smoothly escape from an electric shock state. Furthermore, there can be provided a safer ignition device which can prevent a secondary damage due to the destruction of the device, a leak, and the like.

Furthermore, the DC/AC conversion device is provided with the conduction confirmation device which confirms whether the wiring through which the output of the DC power supply device is connected to the DC/AC conversion device is connected, and outputs the result of conduction confirmation, whereby a leak and the like can be prevented in advance, a continuous electric shock can be prevented, and the occurrence of serious damage can be prevented and/or suppressed.

Moreover, the conduction confirmation device outputs the result of conduction confirmation via the wiring through which DC power is outputted, whereby a leak and the like can be prevented in advance, a continuous electric shock can be prevented, and the occurrence of serious damage can be prevented and/or suppressed, while suppressing cost-up of the device.

Additionally, the conduction confirmation device outputs the result of conduction confirmation when the power circuit breaker 104 interrupts the output of the DC power supply device 103, whereby a leak and the like can be more reliably prevented in advance, a continuous electric shock can be prevented, and the occurrence of serious damage can be prevented and/or suppressed.

In addition, the DC power supply device 103 prohibits the generation of DC power when the result of conduction confirmation is a result that is not normally connected, whereby a leak and the like can be prevented in advance, a continuous electric shock can be prevented, and the occurrence of serious damage can be prevented and/or suppressed, while suppressing dissipation of power.

Besides, the DC/AC conversion device 102 prohibits the operation of converting into AC power when the result of conduction confirmation is a result that is not normally connected, whereby a leak and the like can be prevented in advance, a continuous electric shock can be prevented, and the occurrence of serious damage can be prevented and/or suppressed, while preventing failures and the like of the device.

The present invention can freely combine the respective embodiments and appropriately modify and/or omit the respective embodiments, within the scope of the present invention.

What is claimed is:

1. An ignition device comprising:

an ignition plug which generates a plasma discharge for each ignition operation among a plurality of ignition operations, each of the plurality of ignition operation being for generating combustion;

a DC/AC conversion device which converts DC power into AC power and outputs the converted AC power toward said ignition plug;

a DC power supply device which is arranged in a different package from that of said DC/AC conversion device, generates the DC power that is for being converted into the AC power by said DC/AC conversion device, and outputs the DC power to be supplied to said DC/AC conversion device via wiring; and a power circuit breaker that conducts and/or interrupts the output of said DC power supply device, wherein said power circuit breaker interrupts the output of said DC power supply device at least once between adjacent ones of the plurality of ignition operations, such that the DC power is not supplied to said DC/AC conversion device while the output of said DC power supply device is interrupted.

2. The ignition device according to claim 1, wherein said power circuit breaker is arranged in the same package together with said DC power supply device.

3. The ignition device according to claim 1, wherein said power circuit breaker conducts the output of said DC power supply device before said DC/AC conversion device starts operation that is for outputting the AC power toward said ignition plug.

4. The ignition device according to claim 1, wherein said power circuit breaker conducts the output of said DC power supply device after said DC/AC conversion device starts operation that is for outputting the AC power toward said ignition plug.

5. The ignition device according to claim 1, wherein said power circuit breaker interrupts the output of said DC power supply device before said DC/AC conversion device stops operation that is for outputting the AC power toward said ignition plug.

6. The ignition device according to claim 1, wherein said power circuit breaker interrupts the output of said DC power supply device after said DC/AC conversion device stops operation that is for outputting the AC power toward said ignition plug.

7. The ignition device according to claim 1, wherein said DC/AC conversion device is provided with a conduction confirmation device which confirms whether the wiring through which the output of said DC power supply device is connected to said DC/AC conversion device is connected, and outputs a result of conduction confirmation.

8. The ignition device according to claim 7, wherein said conduction confirmation device outputs the result of conduction confirmation via the wiring through which the DC power is outputted.

9. The ignition device according to claim 7, wherein said conduction confirmation device outputs the result of conduction confirmation when said power circuit breaker interrupts the output of said DC power supply device.

10. The ignition device according to claim 7, wherein said DC power supply device prohibits the generation of the DC power when the result of conduction confirmation is a result that is not normally connected.

11. The ignition device according to claim 7, wherein said DC/AC conversion device prohibits the operation of converting into the AC power when the result of conduction confirmation is a result that is not normally connected.

12. The ignition device according to claim 1, wherein said DC power supply device comprises a DC/DC conversion device.

* * * * *